United States Patent [19]

Lucas

[11] Patent Number: 4,669,245

[45] **Date of Patent: * Jun. 2, 1987**

[54] A DEVICE FOR THE FORMING JOINTS IN A FLOOR PAVEMENT OF THE INDUSTRIAL TYPE GENERALLY MADE OF CONCRETE

[76] Inventor: Jean-Claude Lucas, 6, Allée Gaston Buy, 35400 Saint-Malo, France

[ * ] Notice: The portion of the term of this patent subsequent to Apr. 2, 2002 has been disclaimed.

[21] Appl. No.: 697,398

[22] Filed: Feb. 1, 1985

[30] Foreign Application Priority Data

Feb. 7, 1984 [FR] France ..... 84 01978

[51] Int. Cl.[4] ..... E04B 2/00

[52] U.S. Cl. ..... 52/370; 52/372; 52/318

[58] Field of Search ..... 52/370, 318, 372, 396; 404/48

[56] References Cited

U.S. PATENT DOCUMENTS

| | | | |
|---|---|---|---|
| 859,511 | 7/1907 | Nolte | 52/372 |
| 2,257,421 | 9/1941 | Mabry | 52/689 X |
| 2,651,243 | 9/1953 | Guille | 404/48 |
| 3,023,681 | 3/1962 | Warson | 52/396 X |
| 3,398,497 | 8/1968 | Hellmich et al. | 52/318 X |
| 3,471,987 | 10/1969 | Yelsma | 52/689 X |
| 3,871,787 | 3/1975 | Stegmeier | 52/396 X |
| 3,951,562 | 4/1976 | Fyfe | 52/396 X |
| 4,050,206 | 9/1977 | Utsuyama | 52/396 |
| 4,346,542 | 8/1982 | Tateno | 404/48 X |
| 4,507,902 | 4/1985 | Lucas | 52/370 |

FOREIGN PATENT DOCUMENTS

| | | | |
|---|---|---|---|
| 667411 | 10/1929 | France | 52/318 |

OTHER PUBLICATIONS

PTO-892, Ser. No. 386,894, dated 11/18/83.

*Primary Examiner*—Carl D. Friedman
*Attorney, Agent, or Firm*—Laff, Whitesel, Conte & Saret

[57] ABSTRACT

The invention provides a device for forming joints in a floor or pavement, generally made of concrete. The device includes a guide bar and assembling members, having oblique legs forming an inverted V. The summit of the inverted V has a part rising from it in the form of a crest with vertical sides and a horizontal edge. The guide bar has a profile with a lower part which has the shape of a two legged clamped-nail, each of the legs of the clamp-nail having on their internal side, at some distance down from the summit of the clamp-nail, a boss forming a locking means for holding together the guide bar and the assembling members when said guide bar is placed astride the crest of an assembling member.

7 Claims, 6 Drawing Figures

A DEVICE FOR THE FORMING JOINTS IN A FLOOR PAVEMENT OF THE INDUSTRIAL TYPE GENERALLY MADE OF CONCRETE

The present invention relates to a device for the formation of joints in a flooring of the industrial type, which is generally made of concrete.

There already is a device which makes it possible to provide, at the same time, the following operations:

1. planking;
2. support for a vibrating guide bar;
3. a dry dilatation joint which provides for the concrete shrinking; and
4. a dilatation joint to be caulked or filled.

The device described above is claimed in my French Patent Application filed on Dec. 5, 1980, under the No. 80 25822, and now shown in U.S. Pat. No. 4,507,902, granted Apr. 2, 1985.

The first member or guide bar of the device is a bar having a profile which is that of a clothes pin. The guide presents itself in two forms, depending on whether it is desirable to make a joint which is to be caulked or filled, or is to be a so-called dry joint. For the joints which are to be caulked, the guide bar which is used has a profile formed of two legs joined at a summit. The external side of the legs is straight and the width of the guide bar goes decreasing from its summit to its base, so that it is possible to remove it once the flooring or paving has been completed. In order to make so-called dry joints, a slightly different guide bar is used. Its profile is still formed by two legs joined at their summit, but the external sides of the legs comprise swallow tail ears and their lower ends present the shape of a swelling or flange.

The assembling and support members present a profile which comprises two oblique legs, the upper ends of which are joined by a summit topped in its middle by a crest or ridge with vertical sides. The summit has on each side of the ridge a depression, the opening of which is slightly narrowed. The slanted legs are connected by a horizontal ridge which prevents them from separating.

Finally, there are available crossing guides presenting the shape of a dihedral, the edge of which is meant to be vertically placed. The crossing guides have the same height as the assembling and support members.

With those members, a mesh is placed over the surface to be floored or paved. The guide bar parts are cut to the desired sizes. Under the guide bar parts, support and assembling elements are the legs of the guide bar overlapping the crest or ridge of the assembling members. The swellings or flanges on the lower ends of the legs become locked by pressure inside the depressions provided on the summit of the assembling members. As an indication, the mesh has a side which is three to four meters. Then, the distance between two neighboring assembling members may be in the order of 50 cm. The guide bar parts with the assembling members are then placed over the surface to be floored or paved. The crossing guides are positioned in such a manner that the guide bar parts will overlap the small wings of the crossing guides. There is then a first cast of concrete to anchor the assembling members. That assembly operation is generally done the day prior to the casting of the floor.

Through use, it has become obvious that those various members made it possible to obtain the desired results, but that they still could be improved. Thus, the guide bar must resist or withstand important stress, for example, when it supports the vibrating guide bar, without arching or forming a corkscrew shape between the assembling members. In order to solve that problem, it is possible to decrease the spacing of the assembling members, but then that reduces the zones into which the concrete can flow under the guide bar and between two assembling members. There is a reduced keying among the various floor or pavement panels.

In addition, the manufacturing tolerances of the assembling members and of the guide bar are such that the locking of the swellings of the lower ends of the legs of the guide bar in the depressions of the assembling members is not always simple. If the swelling at the bottom of a leg is somewhat too wide or if the opening of a depression is too small, it becomes difficult, and even impossible, to engage the swelling into the depression, the external edge of which is too short to be elastic. If the swellings of the legs are not wide enough, or if the openings of the depressions are a little too wide, the assembling member or members do not hook well under the guide bar at the time of the assembling, and prior to the casting of the concrete layer inside which the bases of the assembling members are buried.

One object of the present invention is to provide a guide bar which is rigid enough to support the stress to which it is subjected, without becoming deformed and without requiring a multiplication of the assembling members.

Another object of the present invention is to provide a fixation means for holding the guide bar on the assembling members, which is practical and efficient.

Another object of the present invention is to provide for assembling members which can also serve for the crossing points.

According to another feature of the present invention, the guide bar has a profile with a lower part which presents the shape of a staple or clamp-nail. The legs of the clamp-nail have a boss on their internal side, at some distance from the summit of the clamp-nail. The assembling members comprise a crest or ridge, the upper edge of which is horizontal. The boss on the legs of the guide bar form a locking means between the guide bar and the assembling members, the guide bar being placed astride the crest or ridge of the assembling members.

According to another feature of the invention, the horizontal side of the crest or ridge of the assembling members comprise a swelling, the extra-thickness of which is practically the same as the thickness of the boss on the legs of the guide bar.

According to another feature of the invention, the upper part of the guide bar, above the clamp-nail, is a hollow beam and each of the external sides of the guide bar comprise at least one swallow tail shaped longitudinal ear.

According to another feature of the invention, the assembling members comprise, on each side of the crest or ridge, a vertical plate which is slightly spaced from the ridge and which is perpendicular to the ridge. The upper horizontal side of the vertical plate is at the same level as the horizontal side of the ridge.

The features of the present invention, as well as others, will be explained more clearly upon reading of the description of embodiments, the description being given with reference to the attached drawings, in which.

Figure 1:
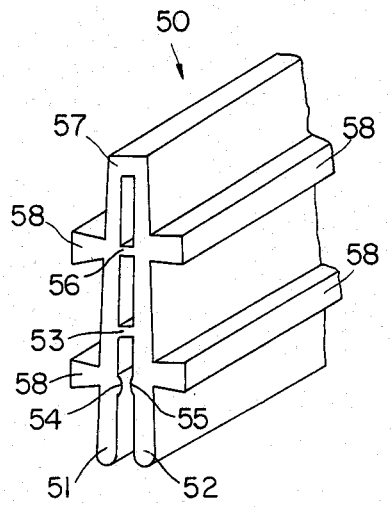
FIG. 1 is a perspective view of the first member.

The first member or guide bar, represented in FIG. 1, has a crest or ridge 50. The lower part of the profile of the guide bar presents the shape of a clamp-nail made up of two closely placed legs 51 and 52 joined at their upper end by a summit 53. The internal sides of legs 51 and 52 comprise bosses 54 and 55 at a certain distance below summit 53. The usefulness of the linear bosses 54 and 55 will be seen later.

The clamp-nail is topped by a hollow beam, the lower wall of which is constituted by summit 53. The hollow beam further comprises a horizontal cover 56 in its median part and an upper horizontal wall 57, which is considerably thicker than the summit 53 and cover 56. The external sides of the hollow beam and the external sides of the legs 51 and 52 of the clamp-nail comprise hollow ears in the shape of a swallow tail 58.

The swallow tail shaped ears 58 are constituted by rings, the summit 53, the upper wall 57 and the cover 56 tend to increase the inertia module of the beam and of the entire guide bar, that is to say, the rigidity of the same. As an example, the approximate dimensions of guide bar 50 may be as follows:

Total height, 5 cm; thickness of the legs, 2 mm; thickness of the upper wall, 3 to 4 mm; height of the ears 58, 5 mm; thickness of summit 53 and of the cover 56, 1.5 mm. A guide bar having the above-given dimensions makes it possible to utilize supports 50 cm apart, or more. In order to easily position the assembling members under guide bar 50, the external sides of guide bar 50 comprise markers, for example, every 50 cm.

Figure 2:
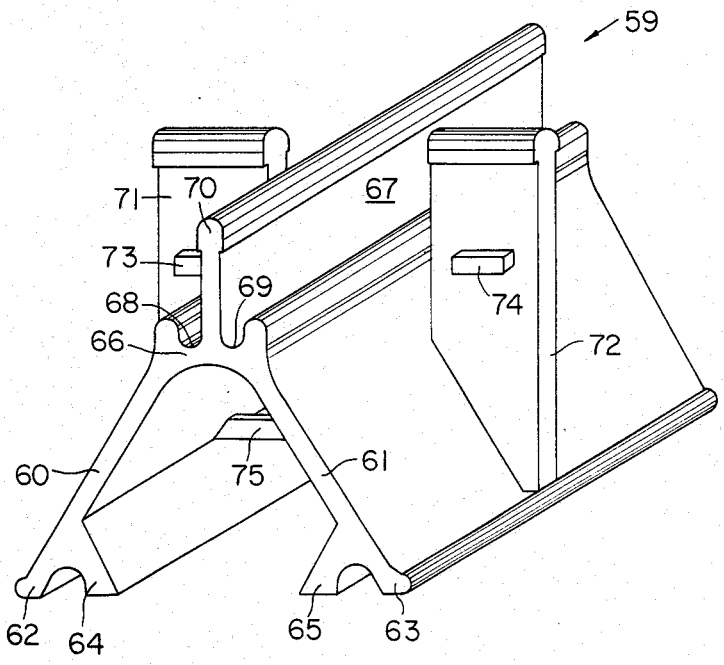
FIG. 2 is a perspective view of an assembling member.

The assembling member 59, represented in FIG. 2, comprises a leg, the profile of which presents the shape of an inverted V. The feet or bottom 60 and 61 of the legs, respectively, comprise points 62 and 63 and heels 64 and 65 which are propped against the legs. The summit 66 of the inverted V has rising from it a crest or ridge 67, the height of which is approximately equal to the internal height of the clamp-nail of guide bar 50.

Summit 66 comprises two depressions 68 and 69, respectively, on each side of the base of crest or ridge 67. Crest or ridge 67 has a section such that the clamp-nail of the guide bar 50 overlaps it while tightening it between the bosses 54 and 55. The top of crest or ridge 67 presents the shape of a swelling 70 which becomes locked between the bosses 54 and 55, the summit 53 and the internal sides of the clamp-nail of guide bar 50 when the latter is placed on member 59. As an indication, the thickness of crest or ridge 67 may be 3.65 mm in its lower and median part, and 3.85 mm at the height of swelling 70, which thus has an extra thickness of 1/10° on each side. That extra thickness is equal to that of bosses 54 and 55 on the inside of legs 51 and 52 of the guide bar. Once hooked, a member 59 can no longer fall because it is held by the bosses which have hooked under the swelling. In addition, considering the length of the legs, 2 cm, which gives a certain elasticity, the manufacturing tolerances on the extra thickness of the swelling and of the bosses then can be of the order of 1/500°, something which can be obtained in the extrusion of conventional plastic materials.

The lower ends of the legs 51 and 52 of the guide bar 50 come to lodge themselves inside the depressions 68 and 69. Thus, the guide bar rests on the assembling member not only by its summit, but by the ends of its legs.

The openings of depressions 68 and 69 may possibly be narrowed. The lower end of legs 51 and 52 may present the shape of a swelling to form an additional locking means.

Vertical plates 71 and 72 rise from the external sides of legs 60 and 61 of member 59. Plates 71 and 72 are perpendicular to the crest or ridge 67. Their upper side is horizontal and at the same level as the horizontal edge of the crest or ridge 67. Plates 71 and 72 rise in the median part of the external sides of legs 60 and 61, over the greatest part of the width of the sides. However, the vertical sides of plates 71 and 72 which are close to crest or ridge 67 are spaced from the latter by a distance which makes it possible to assemble a guide bar 50 on crest or ridge 67. On one of their faces, plates 71 and 72 comprise two small horizontal projecting flanges 73 and 74, at the same level as the bottom of depressions 68 and 69. The thickness of plates 71 and 72 is slightly greater than the thickness of crest or ridge 67 so that the ends of legs 51 and 52, which are not held as in depressions 68 and 69, take their support on the sides of plates 71 and 72. In practice, the summit of plates 71 and 72 may have approximately the same shape and the same dimensions as swelling 70.

Approximately in the same vertical plane as plates 71 and 72, a horizontal bar 75 connects the internal sides of legs 60 and 61 to prevent those legs from separating themselves under the action of a vertical force, or the weight of the vibrating guide bar, for example.

That shape of members 59 makes it possible to use them at the same time as support pieces for the parts of guide bar 50 and as members to execute the crossing points.

Figure 3:
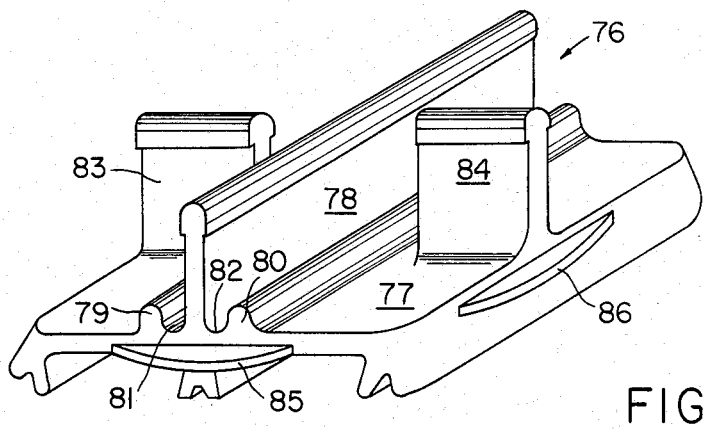
FIG. 3 is a perspective view of an assembling member, the legs of which are replaced with a horizontal plate.

Piece 76 in FIG. 3 constitutes a variation of the assembling member 59 in FIG. 2, in that the V of the latter is opened to 180°. It comprises a horizontal plate 77 which is square in shape. From plate 77, there rises a crest or ridge 78 which is identical with crest 67 in FIG. 2. Crest 78 connects the middle of two opposite sides of plate 77. Plate 77 comprises two longitudinal bosses 79 and 80, parallel to crest or ridge 78, so as to form two depressions 81 and 82, respectively, on each side of crest or ridge 78. Two sections 83 and 84 of the crest or ridge, such 78, rise from the line which joins the middle of the other two opposite sides of plate 77. The sections 83 and 84 are at some distance from crest 78, at a distance which makes it possible to assemble guide bar 50 astride crest or ridge 78. Their other ends are perpendicular to the sides of plate 77.

The sides of plate 77 comprise in their middle flat, horizontal surfaces, such as 85 and 86, visible in FIG. 3, the level of which is slightly inferior to the level of plate 77. The lower face of plate 77 comprises inverted V-shaped feet with very short legs. Members 76 are provided to make thinner floors or pavements than can be made with members 59, or in order to put all of the assembling members at the same level on an uneven ground. Just as with members 59, members 76 also serve to make the crossing points.

When members 76 are anchored into the embedding concrete, the concrete is flush with the upper surface of plate 77. Thus, concrete might run the chance of flowing over plate 77, into depressions 81 and 82 or close to the bases of sections 83 and 84. At the time of the casting of the floor of concrete, it must be possible to remove the guide bars 50, in order to let the concrete mixer go through. The burrs of concrete in the depressions 81 and 82 would make the repositioning of guide bar 50 difficult, or even impossible, without a preliminary cleaning of plate 77. Flat surfaces 85 and 86 are provided in order to prevent that type of incident.

The device according to the present invention efficiently solves the problem of the tightness of the joints. Indeed, when the concrete shrinks, it pinches the two swallow tail-shaped ears 58 which fit on each side of guide bar 50, so that there is obtained an efficient two level tightness. That traction on the four ears 58 can go as far as the breaking of summit 53 and of cover 56 which, to that end, are made thinner than the summit 57 and ears 58. In addition, the shrinking crack is directed only on the upper 5 cm of the floor or pavement corresponding to the height of guide bar 50. Below that, there is an anarchic shrinking crack which ensures a perfect keying of the floor or pavement panels.

In addition, the device according to the present invention makes it possible to produce floors or pavements running from 6 cm to 20 cm in thickness, depending on whether assembling members 76 or assembling members 59 are used.

Figure 4:
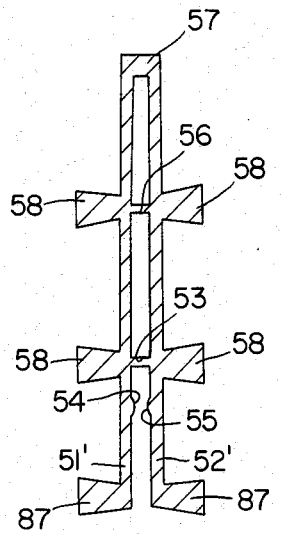
FIG. 4 is a section view of a variation of the first member.

In FIG. 4, there has been shown in section 8, a variation of the guide bar in FIG. 1. Generally speaking, there have been preserved, in FIG. 4, the same reference numbers to designate the same members. In FIG. 4, crest or ridge 57 is extended downward by two legs 51′ and 52′, which are joined at their upper ends by summit 53. The internal sides of legs 51′ and 52′ comprise bosses 54 and 55 at a certain distance from summit 53. Above summit 53, there is found again, the hollow beam formed by parts 56 to 58. In the variation of FIG. 4, the lower ears 58 are at the level of summit 53, but that is not mandatory.

According to a variation, a third pair of swallow-tail ears 87 are provided on each side of the lower ends of legs 51′ and 52′.

That structure with three pairs of superimposed ribs further improves the rigidity of the guide bar. As a consequence, it is possible to increase the spacing between the assembling members, or to support heavier vibrating guide bars. They also ensure a better tightness.

Figure 5:
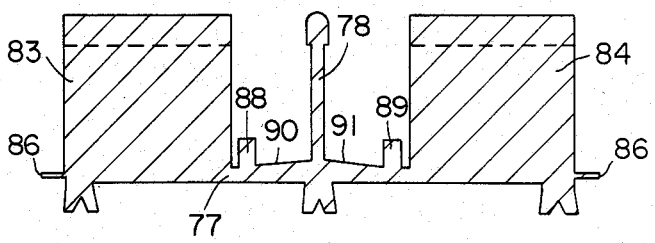
FIG. 5 is a section of a variation of the member in FIG. 3, which is fitted to the first member in FIG. 4.
Figure 6:
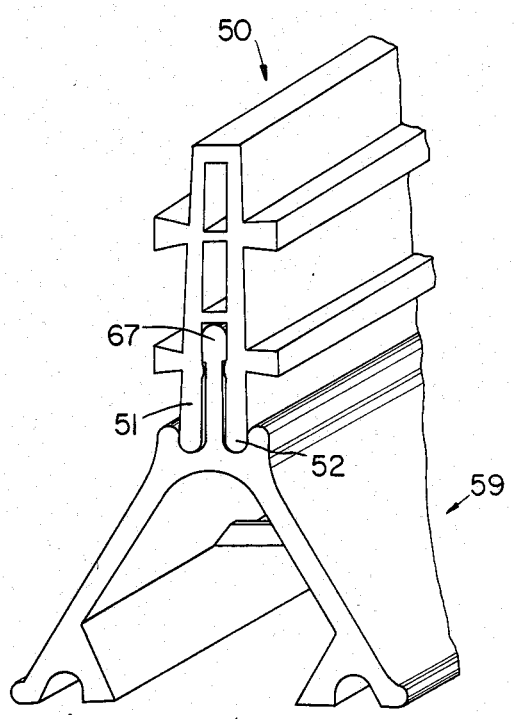

The assembling member in FIG. 5 is a variation of the one in FIG. 3. It is provided in order to be used with the guide bar in FIG. 4.

FIG. 5 uses the same reference numbers as in FIG. 3 to designate the same parts. There are found again elements 77, 78, 83 and 86. However, elements 77 to 82 are eliminated and replaced with, on the upper face of plate 77, two linear lug pieces 88 and 89, which are parallel to crest or ridge 78 and which are respectively spaced from the latter by a distance equal to the distance between the external end of an ear 87 and the internal face of a leg 51′ or 52′. Between each lug piece 88 or 89 and crest 78, the upper face of plate 77 has a profile which corresponds to the lower profile of the ears 87. In the embodiment which is represented, there are two slanted planes 90 and 91.

Thus, at each assembling member, the bottoms of legs 51′ and 52′ are held tightened by lug pieces 88 and 89, something which wedges the bosses 54 and 55 under the swelling of crest or ridge 78.

Those who are skilled in the art will readily perceive how to modify the invention. Therefore, the appended claims are to be construed to cover all equivalent structures which fall within the true scope and spirit of the invention.

I claim:

1. A device which may be set in place before pouring a concrete floor or pavement of the industrial type, said device forming joints in a floor or pavement, said device consisting of a guide bar and assembling members, said assembling members comprising an integral member having two oblique legs and a crest, said legs being set at an angle with respect to each other and rising to said crest, the summit of said angle having rising from it said crest with vertical sides and a horizontal edge, said guide bar being an integral device and having a profile with a lower part which has the shape of a two-legged clamp-nail; each of the legs of the clamp-nail having on their internal side, at some distance down from the summit of the clamp-nail, at least one boss for snapping over said crest and forming a locking means for holding together the guide bar and the assembling members, when said guide bar is placed astride a crest of the assembling members, the top of said guide bar setting the surface level of said floor or pavement.

2. The device according to claim 1 wherein the horizontal edge of the crest of the assembling members comprise a swelling which provides extra-thickness which is substantially the same as the thickness of the boss of the legs of the guide bar.

3. The device according to claim 1 wherein said guide bar has an upper part which is above the clamp-nail, said upper part containing a hollow beam, and at least one longitudinal ear on each external side of said guide bar, each longitudinal ear forming a swallow tail.

4. The device according to one of the claim 1–3 wherein the assembling members comprise, on each side of the crest a vertical plate spaced away from the crest and extending away from an upper surface of said oblique legs, said plate being set in a plane extending perpendicularly with respect to said crest and being at the same level as the longitudinal edge of the crest.

5. The device according to claim 4 wherein the guide bar comprises, on its external sides, two pairs of ears, the profile of which form a swallow tail, the first pair of said ears being located at a height which is closer to the height of the boss and the other one of said ears being at a mid-distance between the first pair and the summit.

6. The device according to one of the claims 1–3 wherein the guide bar comprises, on its external sides, two pairs of ears, the profile of which form a swallow tail, the first pair of said ears being located at a height which is closer to the height of the boss and the other one of said ears being at a mid-distance between the first pair and the summit.

7. The device according to claim 6 wherein the lower ends of the oblique legs are fitted with ears.

* * * * *